United States Patent [19]

Roche et al.

[11] Patent Number: 4,646,844

[45] Date of Patent: Mar. 3, 1987

[54] DIVERTER/BOP SYSTEM AND METHOD FOR A BOTTOM SUPPORTED OFFSHORE DRILLING RIG

[75] Inventors: Joseph R. Roche, Humble; Gabriel G. Alexander, Houston, both of Tex.

[73] Assignee: Hydril Company, Los Angeles, Calif.

[21] Appl. No.: 686,036

[22] Filed: Dec. 24, 1984

[51] Int. Cl.[4] ..... E21B 33/06

[52] U.S. Cl. ..... 166/379; 166/386; 166/86; 166/88

[58] Field of Search ..... 166/84, 86, 87, 88, 166/344, 363, 374, 379, 386

[56] References Cited

U.S. PATENT DOCUMENTS

| | | | |
|---|---|---|---|
| 3,347,567 | 10/1967 | Watkins | 166/341 |
| 3,465,817 | 9/1969 | Vincent . | |
| 3,647,245 | 3/1972 | Hanes et al. | 285/106 |
| 3,791,442 | 2/1974 | Watkins | 166/359 |
| 3,889,747 | 6/1975 | Regan et al. | 175/7 |
| 4,138,148 | 2/1979 | Zaremba | 285/317 |
| 4,434,853 | 3/1984 | Bourgeois | 166/88 |
| 4,444,250 | 4/1984 | Keithahn et al. | 166/84 |
| 4,444,401 | 4/1984 | Roche et al. | 277/30 |
| 4,456,062 | 6/1984 | Roche et al. | 166/84 |
| 4,456,063 | 6/1984 | Roche | 166/84 |

*Primary Examiner*—James A. Leppink
*Assistant Examiner*—William P. Neuder
*Attorney, Agent, or Firm*—Dodge, Bush & Moseley

[57] ABSTRACT

A system adapted for alternative use as a diverter or a blowout preventer for a bottom supported rig and adapted for positioning beneath a rotary table of the drilling rig is disclosed. The system comprises a fluid flow controller and at least two bases adapted for being alternatively removably secured to the controller. When the first base is in combination with the fluid flow controller, the system may be used only as a diverter and when the second base is used in combination with the fluid flow controller the system may be used only as a blowout preventer. A method according to the invention includes steps for installing the system adapted for alternative connection as a diverter or a blowout preventer for a bottom supported drilling rig after structural casing has been set in a borehole.

19 Claims, 4 Drawing Figures

DIVERTER/BOP SYSTEM AND METHOD FOR A BOTTOM SUPPORTED OFFSHORE DRILLING RIG

BACKGROUND OF THE INVENTION

1. Field of the Invention

This invention relates generally to diverter and blowout control systems for drilling rigs. In particular, the invention relates to diverter and blowout preventer systems and methods for use with bottom supported offshore drilling rigs.

2. Description of the Prior Art

When drilling a well from a bottom supported offshore rig, it is desirable that a diverter be provided during shallow hole drilling through the drive pipe. Such a diverter is typically provided below a rig floor between the casing and the rotary table of the drilling rig for safely venting or controlling unbalanced well bore pressure which may produce an upward flow of drilling fluid in a conduit. Such an occurrence, called a "kick", typically a pressurized gas accumulation in the fluid of the conduit, is often encountered in top hole drilling making a fluid flow controller essential before high pressure blowout preventers are connected to the drilling system.

U.S. Pat. Nos. 4,456,062, 4,456,063, 4,502,534 and 4,444,401, assigned to the same assignee as the assignee of the present application, disclose a "failsafe" diverting system for a floating drilling rig. The disclosed system is "failsafe" in that when a "kick" occurs during shallow hole drilling of a top hole well before a blowout preventer stack has been provided, the "kick" can not be accidentally confined by the flow diverter apparatus to build pressure and explode, even if controls are misconnected or malfunctioning. The above mentioned patents disclose a diverter or "fluid flow controller" adapted for positioning within a housing permanently secured to the floating drilling rig floor below the rotary table.

Diverters may also be provided for bottom supported offshore drilling rigs. Such diverters, because of their capability of sealing the annular space between the drilling conduit or riser and the drill pipe, may also be used as a low pressure blowout preventer. Such a diverter/BOP system is disclosed in U.S. Pat. No. 4,524,832 to Roche et. al. and is assigned to the same assignee as that of this application. Such application is incorporated herein for all purposes.

When a drilling rig operator uses such a diverter/-BOP system, he must be assured of the mode that the system is in. If the operator believes the system to be in a diverter mode, but yet the system is in a BOP mode, a kick of pressure greater than the pressure rating of the system could result in catastrophic damage to the drilling rig and its personnel. If the operator believes the system to be in the BOP mode because sufficient casing has been set, but yet the system is actually in the diverter mode, the well cannot be "controlled" in the sense of killing the kick with drilling mud with the blowout preventer closed and circulating it out via a choke line to a choke manifold. Rather, the kick is diverted via the vent line system and may flow until the shallow gas is dissipated. It is necessary therefore to provide systems which can assure the drilling crew and the drilling superintendent that the diverter/BOP system described above is in a "for sure" mode, either as a diverter or as a BOP.

IDENTIFICATION OF OBJECTS OF THE INVENTION

It is an object of this invention to provide a system adapted for alternative use as a diverter or a blowout preventer where the system can be made up in only a preplanned, safe, functional mode in either the diverter mode or the BOP mode.

It is another object of the invention to provide a system comprising a fluid flow controller and two bases alternatively removably secured to the controller which facilitate nippling up as a diverter in one mode and as a blowout preventer in an alternative mode.

It is still another object of the invention to provide two telescoping spools having bases at their upper ends and connection means at their lower ends which are configured so that it is impossible to inadvertently install the wrong spool for either a diverter mode or a subsequent blowout preventer mode as dictated by the smallest diameter casing string which has been set while drilling a well.

SUMMARY OF THE INVENTION

The above identified objects of the invention as well as other advantages and features of the invention result from a novel system adapted for alternative use as a diverter or a blowout preventer for a bottom supported drilling rig and adapted for positioning beneath a rotary table of the drilling rig.

The system comprises a fluid flow controller and at least two bases adapted for being alternatively removably secured to the controller. When the first base is in combination with the fluid flow controller, the system may be used as a diverter. When the second base is used in combination with the fluid flow controller, the system may be used as a blowout preventer.

The system can be madeup in only a preplanned, safe, functional diverter mode or in subsequent blowout preventer modes as dictated by the smallest diameter casing string which has been set while drilling a well.

A method according to the invention includes steps for installing a system adapted for alternative connection as a diverter or a blowout preventer for a bottom supported drilling rig after structural casing has been set in a borehole.

BRIEF DESCRIPTION OF THE DRAWINGS

The objects, advantages and features of the invention will become more apparent by reference to the drawings which are appended hereto and wherein like numerals indicate like parts and wherein an illustrative embodiment of the invention is shown, of which.

DESCRIPTION OF THE INVENTION

The system S embodying the present invention is shown in detail in FIGS. 1–4. The system S, adapted for alternative use as a diverter or a blowout preventer for a bottom supported drilling rig, includes a fluid flow controller 10, an installation base 12, a first telescoping spool 14 integral with a first or diverter base 14*a* and a second telescoping spool 16 integral with a second or blowout preventer base 16*a*.

Figure 1:
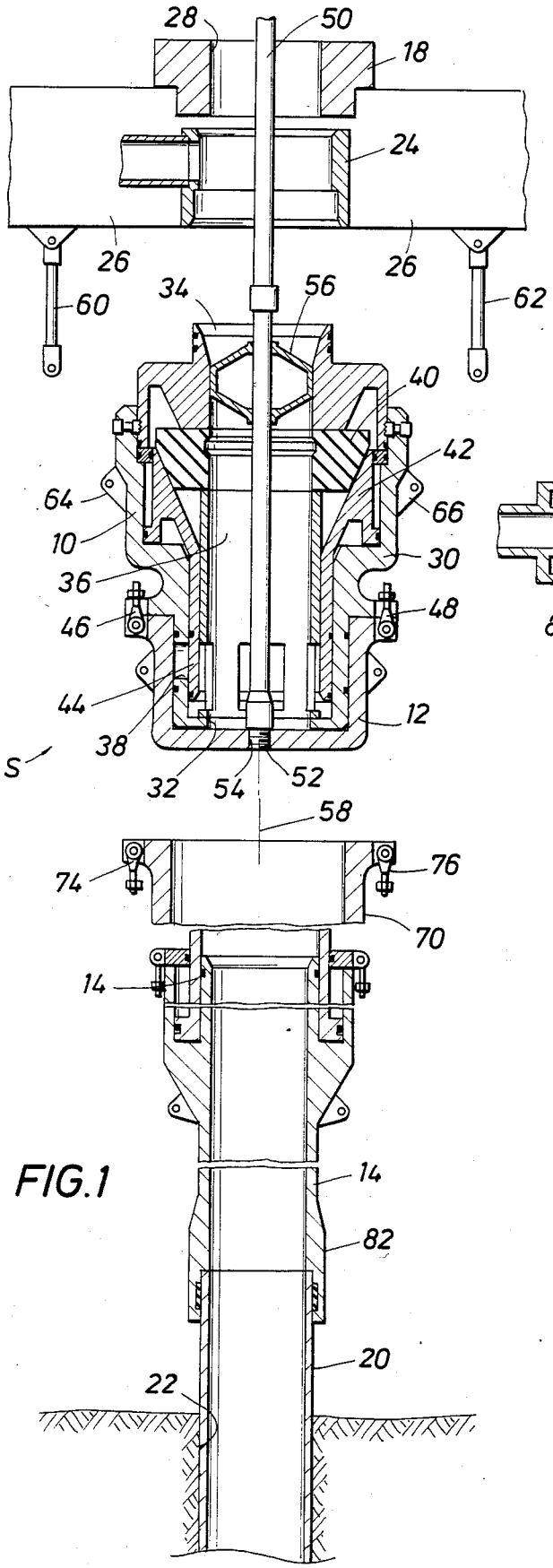
FIG. 1 is a vertical sectional illustration of the installation of a fluid flow controller beneath a drilling rig rotary table and shows an installation base used for installing the controller.

FIG. 1 illustrates the apparatus and method for installing a system adapted for alternative connection as a diverter or blowout preventer for a bottom supported drilling rig positioned beneath a rotary table 18 of the drilling rig after structural casing 20 has been set in a borehole 22. The fluid flow controller 10 is raised for connection to the permanent fixture 24 attached to the support beams 26 beneath a drilling rig floor. The rotary table 18 has a bore 28 therein which may be positioned to coincide with that of the permanent fixture 24 thereby allowing tubular members to be inserted via the bore 28 of the rotary table 18 and the permanent fixture 24 to positions below.

The fluid flow controller 10, according to the invention, is similar to that described in detail in U.S. Pat. No. 4,456,063, assigned to the same assignee as the assignee of the present application. Such application is incorporated herewith for all purposes.

The fluid flow controller 10, as illustrated in FIGS. 1–4, includes a controller housing 30 having a lower cylindrical opening 32 and an upper cylindrical opening 34 and a vertical flow path 36 therebetween. An outlet passage 38 is provided in a housing wall of the controller 10. An annular packing element 40 is provided within the controller housing 30 and an annular piston means 42 is adapted for moving from the first or lower position, as shown in FIGS. 1–4, to a second or upper position. In the first position, the piston wall 44 prevents interior fluid from communicating with the outlet passage 38 in the controller housing wall. In the upper position, the piston wall 44 allows fluid communication of the interior fluid with the outlet passage 38 and urges the annular packing element 40 to close about an object extending through the flow path 36 of the housing 30 such as a drill pipe or to close the vertical flow path 36 through the housing 30 in the absence of any object in the vertical flow path 36.

As shown in FIG. 1, after the initial bore in the sea floor is formed, as illustrated by the borehole 22, a structural casing 20 is provided therein. The structural casing 20 typically has a thirty (30) inch outside diameter. The fluid flow controller 10 and an installation base 12 stored in the drilling rig at a sublevel below the drilling rig floor is positioned for connection with a drill pipe extending through the rotary table 18. The base 12 is connected to the controller 10 by fasteners 46 and 48. In the preferred embodiment a five (5) inch drill pipe 50 having an externally threaded end 52 is threadedly received into an axially located internally threaded bore 54 of the installation base 12. The controller 10 is thereby axially aligned above the structural casing 20 ahd below the bore 28 of the rotary table 18.

The installation base 12 is constructed so as to cover the outlet passage 38 of the controller 10 in order to prevent entry of foreign matter or debris into the outlet passage 38. A centralizer 56 aids in the positioning of the drill pipe 50 along the axis 58 of the controller 10.

Figure 2:
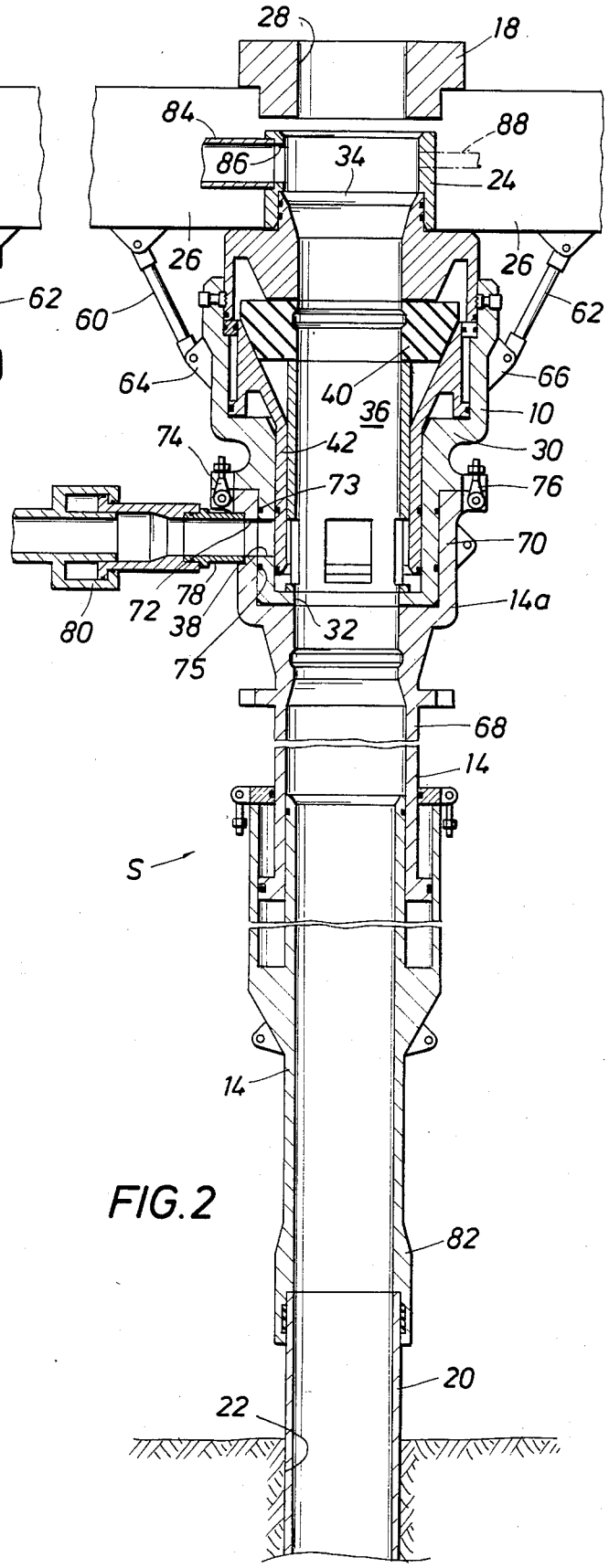
FIG. 2 is a vertical sectional view of the system in the diverting mode according to the invention in which a first telescoping spool having a first base at its upper end is connected to the fluid flow controller.

The flow controller 10 is then raised into position as seen in FIG. 2 whereupon structural support links 60 and 62 secured to support beams 26 are connected to flanges 64 and 66, respectively, of the controller 10 to provide a means for securing the fluid flow controller 10 to the permanent fixture 24 beneath the rotary table 18.

A first telescoping spool 14, collapsed and pinned, is positioned between the structural casing 20 and the fluid flow controller 10. The diverter or first base 14*a* integral with spool 12 has an upwardly facing annulus 70 adapted for sealing engagement about the lower opening 32 of the fluid flow controller 10 and the outlet passage 38 provided in the housing wall of the controller 10. A circumferential seal 73 about outlet passage 38 in the outside surface of controller housing 30 provides sealing with the inner surface of annulus 70. The diverter base 14*a* has a port 72 in the upwardly facing annulus 70 adapted for communication with the outlet passage 38 in the fluid flow controller 10. The diverter base 14*a* is removably secured to the controller by fasteners 74 and 76. The fasteners 74 and 76 are threaded studs rotatably fastened to the first base 14*a* and having a nut threadedly received on each stud for securing the controller 10 to the base 14*a*.

The fluid flow controller 10 and the diverter base 14*a* are provided with means for aligning the controller 10 both axially and angularly with the base 14*a* as is known in the prior art. Aligning means are disclosed in U.S. Pat. No. 4,456,063 to Roche and may be advantageously provided for alignment in this invention. The Roche '063 patent is assigned to the same assignee as the assignee of the present application and is incorporated herewith for all purposes.

The vent line comprising a twelve (12) inch spool 78 removably connected to the port 72 of the diverter base 14*a* may be clamped to a pipe vent line or to a flexible vent line 80 in the diverting mode.

Additionally, a blast deflector (not shown) as described in U.S. patent application Ser. No. 456,206, U.S. Pat. No. 4,486,915 may advantageously be provided to deflect diverted fluids away from the drilling rig in a downwind direction. The above U.S. patent application Ser. No. 707,521, U.S. Pat. No. 4,566,494 is assigned to the same assignee as the assignee of the present application and is incorporated herewith for all purposes.

The first telescoping spool 14 includes an overshot connection 82 integrally disposed on its lower end. The overshot connection 82 slides over the outer diameter of the structural casing 20 to connect the first telescoping spool and integral diverter base 14*a*. The overshot connection 82 of the first telescoping spool 14 is sized so that it may be made up only with the structural casing 20 which conventionally has a thirty (30) inch outside diameter. In other words, the overshot connection 82 is sized so it can only be made up with the exact diameter casing string which has been set, i.e. 30" structural casing. The overshot connection and therefore the first telescoping spool connected to casing 20 can only be used in a preplanned, safe and functional diverter mode. The drilling crew would find it impossible to connect the overshot connection 82 to a twenty (20) inch conductor casing, for example.

In normal operation, as illustrated in FIG. 2, the fluid returning from the drilling operation returns via the first telescoping spool 14 to the fluid flow controller 10 and back to the drilling rig fluid system via fluid system flow line 84 connected to opening 86 in the permanent fixture 24. A fill up line 88 may be connected to permanent fixture 24 and is illustrated by dashed lines.

The system illustrated in FIG. 2 is to be used as a diverter. During drilling through the structural casing 20 for purposes of providing a borehole for placement of the conductor casing 90, a kick is diverted via outlet 38 as the vertical flow path is closed by packing element 40.

Figure 3:
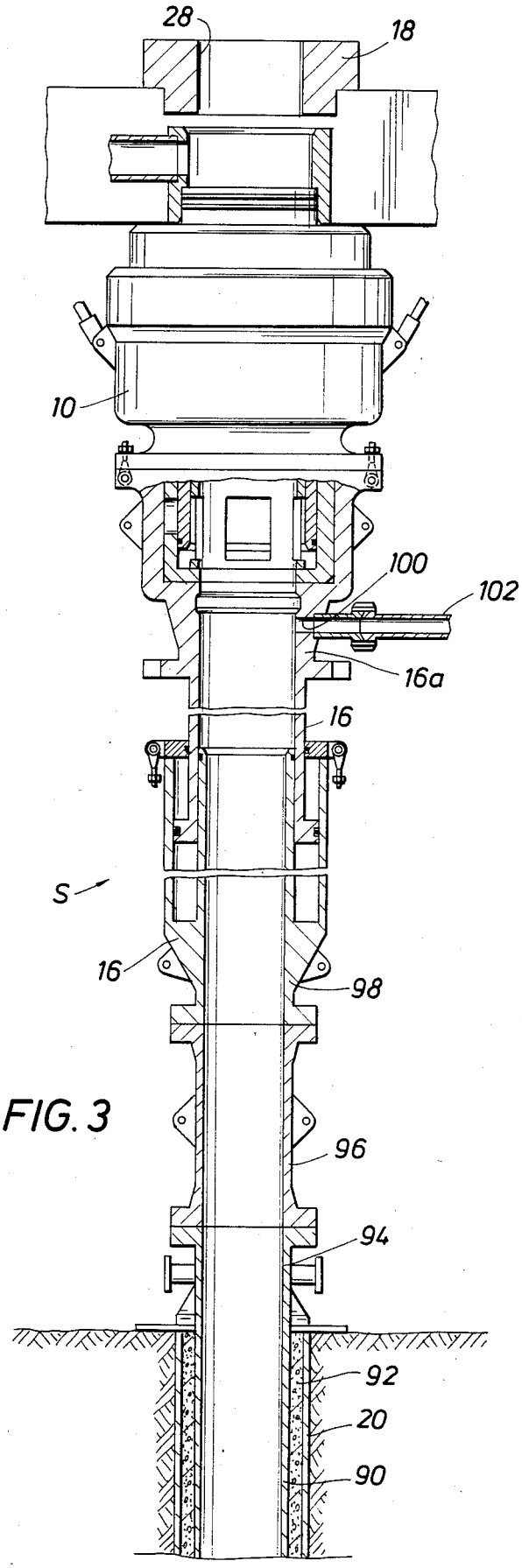
FIG. 3 is a vertical sectional view of the invention in a blowout preventer mode after a conductor casing has been installed and a second telescoping spool has been connected to the conductor casing and further illustrating the connection of a choke/kill line to an aperture of the second base of the second telescoping spool.

Turning next to FIG. 3, an illustration of the system is presented after the conductor casing 90 has been run and cement 92 pumped between the thirty (30) inch O.D. structural casing 20 and twenty (20) inch O.D. conductor casing 90. The conductor casing 90, provides a smaller outside diameter than the conventional thirty (30) inch outside diameter of the structural casing 20. After the first telescoping spool 14 has been collapsed, pinned and removed, a collapsed and pinned second telescoping spool 16 and a spacer spool 96 and mandrel 94 previously secured to spool 16 are positioned between the previously installed controller 10 and conductor casing 90.

After the conductor casing 90 has been installed, the top of it is cut off and a mandrel 94 and spacer spool 96 are connected to the top of the conductor casing 90. Preferably the mandrel 94 and spacer spool have the same diameter as the conductor casing, e.g. twenty (20) inches.

The lower end 98 of the second telescoping spool 16 is connected with the spacer spool 96. The lower end 98 is configured and sized so that it fits only with a spool or mandrel having a twenty (20) inch nominal diameter identical to the spacer spool 96 attached via mandrel 94 to conductor casing 90 thereby preventing an inadvertent installation of the first telescoping spool which is designed to be used only in the diverter mode.

The second or blowout preventer base **16*a* secured to the top of telescoping spool 16 preferably has an aperture 100 for connection with a choke/kill line 102 or, alternatively, the second base could be provided without an aperture. The blowout preventer base 16*a* allows the controller to be used as a low pressure blowout preventer useful in the event of a kick or a dangerous pressure condition in the well. The blowout preventer allows the operator to bring the well under control without diverting a kick overboard. The blowout preventer mode of controller 10 may be designed to withstand relatively low well pressure, e.g. 1000 or 2000 psi. The choke/kill line 102** may be used as with any closed blowout preventer to pump down kill mud via the drill pipe to bring the kick under control by circulating the kick out via a choke manifold.

Figure 4:
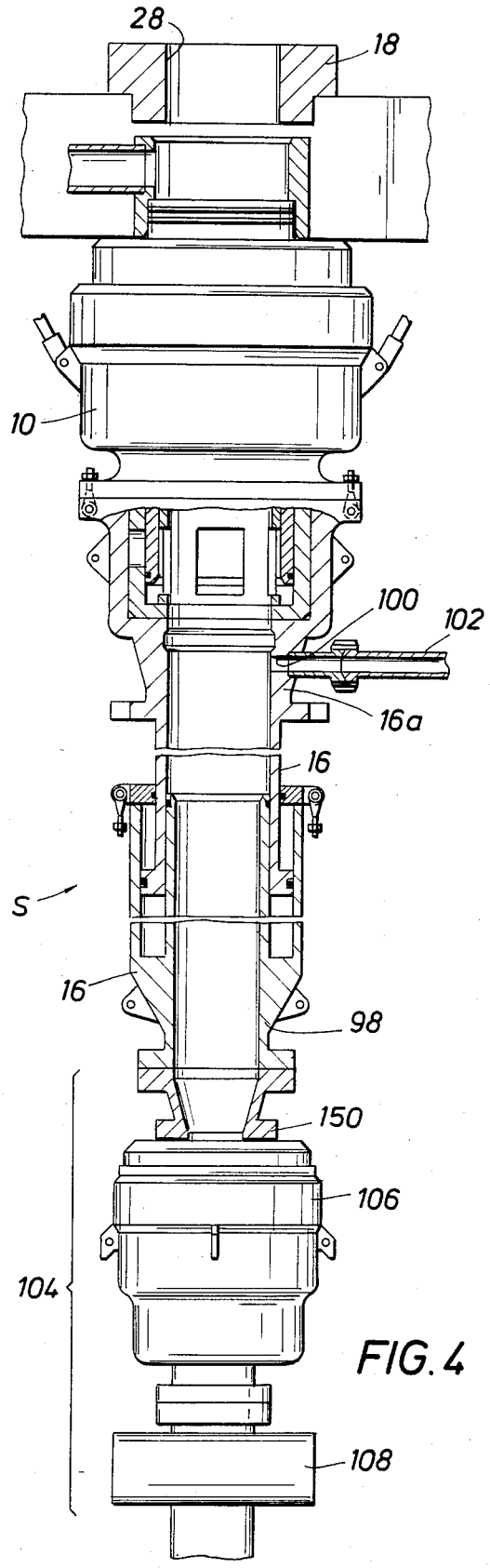
FIG. 4 is a vertical sectional view illustrating the invention in a second blowout preventer mode after a high pressure blowout preventer stack is connected below the second telescoping spool.

FIG. 4 illustrates the use of the second telescoping spool 16 where the well has further been drilled so that a casing string (not shown) typically of $13\frac{5}{8}$ inch diameter may be landed and cemented within the conductor casing 90. According to the invention the lower connection means 98 of the second telescoping spool 16 illustrated in FIG. 3 may be lifted to allow removal of the spacer spool 96 and mandrel 94.

A high pressure blowout preventer stack 104 may then be connected between the lower connection means 98 of the second spool 16 and the $13\frac{5}{8}$ inch casing string. The high pressure blowout preventer stack 104 in the preferred embodiment comprises a $13\frac{5}{8}$ inch annular blowout preventer 106 and one or more $13\frac{5}{8}$ inch ram blowout preventer 108. A diameter reducing mandrel spool 150 is connected between the 20 inch lower end 98 of spool 16 and the $13\frac{5}{8}$ inch annular blowout preventer.

As shown in the figures and discussion above, the flow controller is in place for substantially all the drilling phases of the offshore rig after the structural casing has been placed in the initial hole in the sea floor.

Various modifications and alterations in the desired structures will be apparent to those skilled in the art of the foregoing description which does not depart from the spirit of the invention. For this reason, these changes are desired to be included in the appended claims. The appended claims recite the only limitation of the present invention and the descriptive manner which is employed for setting forth the embodiments and is to be interpreted as illustrative and not limitative.

What is claimed is:

1. A system adapted for alternative use as a diverter or a blowout preventer for a bottom supported drilling rig and adapted for positioning beneath a rotary table of the drilling rig, the system comprising:

a fluid flow controller having a controller housing with a lower opening and an upper opening and a vertical flow path therebetween and an outlet passage provided in its housing wall, at least two bases adapted for being alternatively removably secured to said controller about said lower opening of said controller housing, said first base having an upwardly facing cylindrical receptacle adapted for sealing engagement about the lower opening of said fluid flow controller and the outlet passage provided in the controller housing wall, said first base having a port adapted for communication with the outlet passage in said fluid flow controller, and said second base having an upwardly facing cylindrical receptacle adapted for sealing engagement about the lower opening of said fluid flow controller and the outlet passage provided in the controller housing wall while closing the outlet passage in said fluid flow controller housing wall, whereby, when said first base is connected to said controller housing and said port of said first base is in communication with the outlet passage of the fluid flow controller, the combination of said first base and the fluid flow controller may be used to respond to a kick as a diverter, and when said second base is connected to said controller housing and said outlet passage of said fluid flow controller is closed by said second base, the combination of said second base and the fluid flow controller may be used to control a kick as a blowout preventer.

2. The system of claim 1 wherein said fluid flow controller further comprises:

a packing element disposed within the controller housing, an annular piston having a piston wall disposed with the controller housing, and means for moving said piston from a first position to a second position, whereby in the first position the piston wall prevents interior fluid from communication with the outlet passage in the controller housing wall and in the second position the piston wall allows fluid communication of interior fluid with the outlet passage and urges said packing element to close about an object extending through said controller housing or to close the vertical flow path through said controller housing in the absence of any object in the vertical flow path.

3. The system of claim 1 further comprising a first telescoping spool having an upper end and a lower end, said first base being secured to the upper end of said first telescoping spool, and a first connection means disposed on the lower end of said first telescoping spool for connecting said first telescoping spool only with a structural casing.

4. The system of claim 3 wherein when said first connection means is an overshot connection, said overshot connection being slidable over the structural casing set in a borehole, said system may be used to respond to a kick only as a diverter.

5. The system of claim 1 further comprising a second telescoping spool having an upper end and a lower end, said second base being secured to the upper end of said second telescoping spool, and a second connection means disposed on the lower end of said second telescoping spool for connecting said second telescoping spool only with a tubular member of 20 inch nominal diameter.

6. The system of claim 5 wherein when the second connection means of said second telescoping spool is in communication with the conductor casing, the system may be used to control a kick only as a blowout preventer.

7. The system of claim 1 further comprising means for removably securing said first or second base about said fluid flow controller.

8. The system of claim 1 further comprising means for removably connecting the fluid flow controller beneath the rotary table.

9. The system of claim 1 further comprising a vent line connected to said port of said first base when said port is in communication with the outlet passage, said vent line including a spool extending from said port of said first base when said system is used as a diverter.

10. The system of claim 1 further comprising an aperture disposed in said second base adapted for communication with the interior of the telescoping spool, and a choke/kill line connected to said aperture of said second base when said system is used as a blowout preventer.

11. The system of claim 1 further comprising means for aligning said first base or said second base with said fluid flow controller.

12. A method for installing a system adapted for alternative connection as a diverter or a blowout preventer for a bottom supported drilling rig positioned beneath a rotary table of the drilling rig after structural casing has been set in a borehole, the method comprising the steps of, positioning a first telescoping spool having a lower end and an upper end below the rotary table, said first spool having a first base disposed at its upper end, said first base having a port disposed in its wall;

aligning a fluid flow controller having a controller housing wall outlet passage and adapted for alternative use as a diverter or a blowout preventer so that the controller is substantially vertically aligned between a bore of the rotary table above and the structural casing below;

securing the fluid flow controller beneath the drilling rig rotary table;

stroking said first telescoping spool out until the first base disposed at the upper end of the spool connects with the lower end of the controller and said port disposed in the first base communicates with the controller housing wall outlet passage.

13. The method of claim 12 wherein an overshot connection is disposed at the lower end of the first telescoping spool and the method further comprises the step of sliding the overshot connection over the upper end of the structural casing.

14. The method of claim 13 further comprising the step of connecting a vent line to the port of the first base whereby the system which results may be used as a diverter system.

15. The method of claim 14 and after the well has been drilled for the conductor casing and after the conductor casing has been cemented in the well, further comprising the steps of removing the vent line from the port of the first base, removing the first telescoping spool and the first base, connecting a second base secured to the upper end of a second telescoping spool to the lower end of the fluid flow controller, said second base having an aperture in communication with the interior of the second spool and said second base closing the outlet passage of the fluid flow controller, installing a choke/kill line to the aperture of the second spool, and lowering and securing the lower end of the second telescoping spool when the second spool is in pressure sealing communication with the conductor casing, whereby the system which results may be used as a blowout preventer during drilling through the conductor casing.

16. The method of claim 15 further comprising the steps of, raising the lower end of the second telescoping spool, installing a high pressure blowout preventer spool to the conductor casing, installing a high pressure blowout preventer stack into position above the high pressure spool, and lowering the lower end of the second telescoping spool for pressure sealing communication between the high pressure blowout preventer stack and fluid flow controller.

17. A system adapted for use as a diverter for a bottom supported drilling rig and adapted for positioning beneath a rotary table of the drilling rig, the system comprising:

a fluid flow controller having a controller housing with a lower opening and an upper opening and a vertical flow path therebetween and an outlet passage provided in its housing wall, said fluid flow controller further including:

a packing element disposed within the controller housing, a piston having a piston wall disposed within the controller housing, and means for moving said piston from a first position to a second position, whereby in the first position the piston wall prevents interior fluid from communication with the outlet passage in the controller housing wall and in the second position the piston wall allows fluid communication of interior fluid with the outlet passage and urges said packing element to close about an object extending through said controller housing or to close the vertical flow path through said controller housing in the absence of any object in the vertical flow path, and a first base adapted for being removably secured about said lower opening of said controller housing, said first base having an upwardly facing cylindrical receptacle adapted for sealing engagement about the lower opening of said fluid flow controller and the outlet passage provided in the controller housing wall, said first base having a port adapted for communication with the outlet passage in said fluid flow controller, whereby when said first base is connected to said controller housing and said port of said first base is in communication with the outlet passage of the fluid flow controller, the combination of said first base and the fluid flow controller may be used to respond to a kick as a diverter.

18. A system adapted for use as a blowout preventer for a bottom supported drilling rig and adapted for positioning beneath a rotary table of the drilling rig, the system comprising:

a fluid flow controller having a controller housing with a lower opening and an upper opening and a vertical flow path therebetween and an outlet passage provided in its housing wall, said fluid flow controller further including:

a packing element disposed within the controller housing, a piston having a piston wall disposed within the controller housing, and means for moving said piston from a first position to a second position, whereby in the first position the piston wall prevents interior fluid from communication with the outlet passage in the controller housing wall and in the second position the piston wall allows fluid communication of interior fluid with the outlet passage and urges said packing element to close about an object extending through said controller housing or to close the vertical flow path through said controller housing in the absence of any object in the vertical flow path, and a base adapted for being removably secured about said lower opening of said controller housing, said base having an upwardly facing cylindrical receptacle adapted for sealing engagement about the lower opening of said fluid flow controller and the outlet passage provided in the controller housing wall while closing the outlet passage in said fluid flow controller housing wall, whereby when said base is connected to said controller housing and said outlet passage of said fluid flow controller is closed by said second base, the combination of said second base and the fluid flow controller may be used to control a kick as a blowout preventer.

19. The system of claim 18 further comprising:

an aperture disposed in said second base adapted for communication with the interior of the base, and a choke/kill line connected to said aperture of said second base when said system is used as a blowout preventer.

* * * * *